United States Patent [19]

Aoki et al.

[11] Patent Number: 4,896,008

[45] Date of Patent: Jan. 23, 1990

[54] VACUUM DISCHARGE DEVICE

[75] Inventors: Shinichi Aoki; Kiyoshi Matsuyama, both of Hyogo, Japan

[73] Assignee: Mitsubishi Denki Kabushiki Kaisha, Tokyo, Japan

[21] Appl. No.: 249,836

[22] Filed: Sep. 27, 1988

[30] Foreign Application Priority Data

| | | | |
|---|---|---|---|
| Sep. 29, 1987 | [JP] | Japan | 62-246570 |
| Oct. 20, 1987 | [JP] | Japan | 62-262893 |
| Dec. 7, 1987 | [JP] | Japan | 62-307697 |
| Jun. 29, 1988 | [JP] | Japan | 63-159525 |

[51] Int. Cl.[4] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,167,629 | 1/1965 | Corbine | 200/144 B |
| 3,590,184 | 12/1968 | Wachta | 200/144 B |
| 3,857,005 | 12/1974 | Peche | 200/144 B |
| 4,757,166 | 7/1988 | Slade | 200/144 B |

FOREIGN PATENT DOCUMENTS 59-27050 7/1984 Japan .

*Primary Examiner*—Robert S. Macon

*Attorney, Agent, or Firm*—Birch, Stewart, Kolasch & Birch

[57] ABSTRACT

A vacuum discharge device comprising an insulating envelop having metallic layers formed by a metallizing process respectively on the opposite ends thereof, electrodes disposed within the insulating envelop, and sealing members brazed respectively to the metallic layers. The insulating envelop is a hollow, cylindrical ceramic member having a substantially uniform wall thickness between each wavy inner ridges, or each crest of wavy ridges. The inner creeping length and outer creeping length of the insulating evelop are greater than the distance between the sealing members or between the metallic layers.

19 Claims, 7 Drawing Sheets

FIG. 11
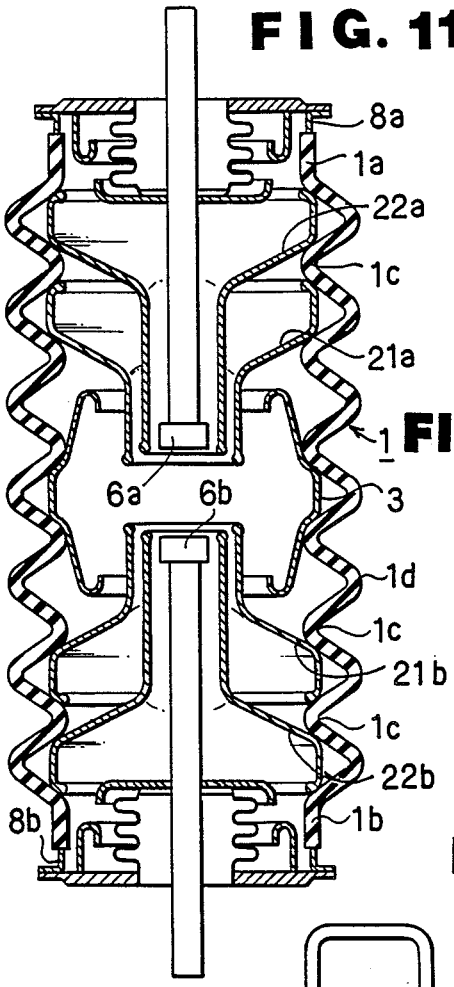
FIG. 8 (b)'
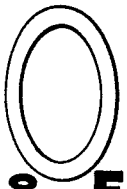
FIG. 8 (a)'
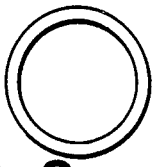
FIG. 8 (b)
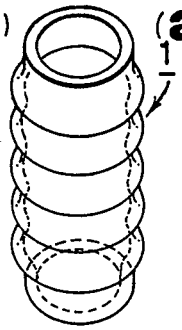
FIG. 8 (a)
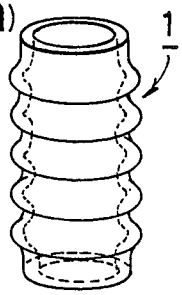
FIG. 8 (d)' FIG. 8 (c)'
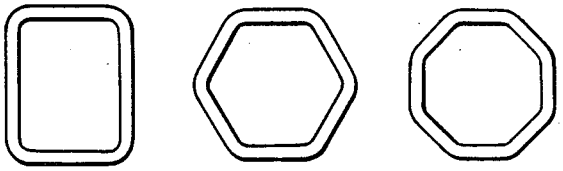
FIG. 8 (e)'
FIG. 8 (e)
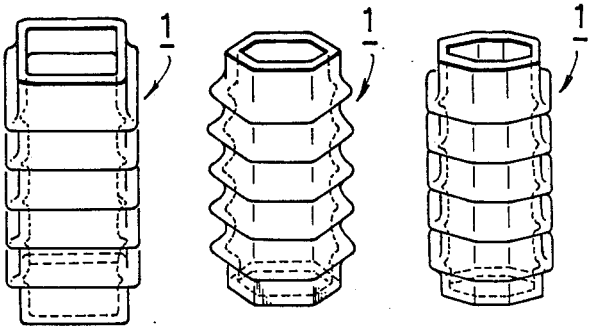
FIG. 8 (d) FIG. 8 (c)

VACUUM DISCHARGE DEVICE

BACKGROUND OF THE INVENTION

1. Field of the Invention

The present invention relates to a vacuum discharge device, such as a vacuum circuit breaker, a vacuum switch, a vacuum triggertron, a vacuum contactor, a vacuum fuse or a vacuum arrester, and, more particularly, to a vacuum discharge device having an insulating envelop supporting a metallic intermediate shielding tube in a state insulated from two electrodes, and having opposite ends provided respectively with metallic layers having electric potentials respectively corresponding to those of the electrodes.

2. Description of the Prior Art

A vacuum switch as shown in FIG. 1 is disclosed in Japanese Patent Publication No. 59-27050. Referring to FIG. 1, indicated at 1 is a ceramic insulating envelop, namely, a component of a vacuum housing, capable of insulating a path for high voltage while a fixed electrode 6*a* and a movable electrode 6*b* are open. The fixed electrode 6*a* and the movable electrode 6*b* have electrode rods 5*a* and 5*b*, respectively. An annular protrusion 2 is formed on the inner surface of the insulating envelop 1 to hold a metallic intermediate shielding tube 3 and a mounting member 4 so that the intermediate shielding tube 3 is insulated from the electrodes 6*a* and 6*b* both when the electrodes 6*a* and 6*b* are open and when the same are closed. Metallic layers 7*a* and 7*b* are formed by a metallizing process on the opposite ends of the insulating envelop 1, and sealing members 8*a* and 8*b* are brazed to the metallic layers 7*a* and 7*b*, respectively, to vacuum-seal the insulating envelop 1. The respective potentials of the sealing members 8*a* and 8*b* are the same as those of the electrodes 6*a* and 6*b*, respectively. A metallic bellows 9 is attached to the central portion of the sealing member 8*b*. The principal functions of the insulating envelop 1 are (1) serving as a component of the vacuum envelop 1, (2) electrically insulating the electrodes 6*a* and 6*b* while the same are separated from each other, and (3) holding the metallic intermediate shielding tube 3 in a state electrically insulated from the electrodes 6*a* and 6*b*. The insulating envelop 1 must have abilities (a) to withstand severe heat shocks to which the insulating envelop is exposed in the manufacturing processes, such as a brazing process and an evacuating process, and in cutting off short-circuit current, (b) to inhibit creeping flashover the penetration breakage in a conditioning process which is carried out during evacuation or after evacuation, (c) to maintain the dielectric strength thereof above a predetermined rated dielectric strength even if the material forming the electrodes is deposited over the inner surface thereof due to the repetitive current interrupting operation, (d) to maintain a necessary dielectric strength even if the outer surface thereof is soiled by salt and dust during the use thereof, and (e) to withstand mechanical shocks and vibrations resulting from the closing and opening operation of the electrodes 6*a* and 6*b*.

Reduction in size of the vacuum switch has been an increasing demand in recent years. Accordingly, it is an important problem to design an insulating envelop having a minimum size and an optimum construction without sacrificing the requisite functions and performance, when the inside diameter and the diameter of the electrodes are specified.

On the other hand, the conventional ceramic insulating envelop 1 is fabricated generally by the following procedure. Alumina powder is molded in a cylindrical molding by a rubber press forming process, the cylindrical molding is machined in a predetermined shape and size, and then the cylindrical molding having the predetermined shape and size is sintered at about 1650° C. in the atmosphere. A paste containing Mo and Mn as principal components is applied to the opposite ends of the sintered cylindrical molding, the paste applied to the opposite ends of the sintered cylindrical body is dried, and then the paste applied to the opposite ends of the cylindrical molding is baked at a temperature in the range of 1400° to 1500° C. to form the metallic layers 7*a* and 7*b*. Then the metallic layers 7*a* and 7*b* formed respectively on the opposite ends of the sintered cylindrical molding are plated with Ni to finish the insulating envelop 1.

The sealing members 8*a* and 8*b* are brazed at approximately 800° C. respectively to the metallic layers 7*a* and 7*b* of the insulating envelop 1. The vacuum switch is assembled from the foregoing parts including the insulating envelop 1, and then the vacuum switch is heated at a temperature higher than 500° C. to evacuate the insulating envelop and the vacuum switch is sealed in a vacuum. In a conditioning process, which is carried out during evacuation or after evacuation, a high voltage is applied across the electrodes to repeat vacuum dielectric breakdown to enhance the dielectric strength. The high voltage applied across the electrodes for vacuum dielectric breakdown is far higher, for example, than 10 kV ac and 70 kV ac respectively for vacuum switches respectively having rated dielectric strengths of 3.3 kV and 3.6 kV.

During the conditioning process, penetration breakage occurs frequently in the insulating envelop 1 of the conventional vacuum switch reducing the yield of the process. Penetration breakage is liable to occur in portions where an electric field is concentrated, namely, portions in the vicinity of the metallic layers 7*a* and 7*b* and in the vicinity of the annular protrusion 2.

The vacuum switch is used more than twenty years in a high tension circuit. During such an extended period of use, the outer surface of the insulating envelop 1 is soiled by the ambient atmosphere containing dust and salt, and the inner surface of the insulating envelop is coated with the material forming the electrodes due to frequent current interrupting operation. Therefore, the initial dielectric strength of the insulating envelop 1 is reduced gradually with time and, eventually, the dielectric strength of the insulating envelop reduces below the rated dielectric strength. Consequently, external or internal creeping discharge occurs in the insulating envelop 1 due to the deterioration of the dielectric strength by injuries from salt brought about by typhoons and injuries from moisture brought about by snow or by an abnormal transient voltage applied to the circuit by lightning or in making and breaking the circuit, and thereby penetration breakage is caused in the vicinity of the metallic layers 7*a* and 7*b* or in the vicinity of the annular protrusion 2 of the insulating container 1. The penetration breakage is a fatal damage in the vacuum switch.

During the conditioning process the vacuum dielectric breakdown voltage across the electrodes 6*a* and 6*b* is increased gradually while vacuum dielectric breakdown occurs between the electrodes 6*a* and 6*b*, and the intermediate shielding tube 3. Eventually, external creeping flashover occurs between the sealing members 8*a* and 8*b* on the insulating envelop 1. In some cases, the external flashover causes penetration breakage across the wall of the insulating envelop 1 in the end portions 1*a* and 1*b* of the insulating envelop 1 or in a portion near the annular protrusion 2. If penetration breakage occurs in the insulating envelop during the conditioning process, the vacuum switch becomes defective and, since it is impossible to repair such a defective vacuum switch, the yield of the manufacturing process is reduced.

Accordingly, the improvement of the yield of the conditioning process for the vacuum switch having the intermediate shielding tube 3 can be achieved by (1) a method of reducing the intensity of the electric field acting on the intermediate shield 3 or (2) a method of preventing the vacuum dielectric breakdown of the intermediate shielding tube 3.

Japanese Utility Model Publication Nos. 58-43152 and 58-43153 disclose vacuum switches as shown in FIGS. 2(*a*) and 2(*b*) employing both the foregoing methods (1) and (2). The vacuum switch of FIG. 2(*a*) is provided with two second intermediate shielding tubes 10*a* and 10*b* between a first intermediate shielding tube 3 and two electrodes 6*a* and 6*b*. The vacuum switch of FIG. 2(*b*) is provided with a first intermediate shielding tube 3, two second intermediate shielding tubes 10*a* and 10*b*, and two third intermediate shielding tubes 11*a* and 11*b*. Stacking the intermediate shielding tubes 3, 10*a* and 10*b*, or the intermediate shielding tubes 3, 10*a*, 10*b*, 11*a* and 11*b* one over another increases the length of the insulating tube 1 of the vacuum switch and makes the construction of the vacuum switch complicated, which deteriorates handling facility of the vacuum switch, increases assembling steps, requires an insulating envelop having an increased inner surface for supporting the intermediate shielding tubes 3, 10*a* and 10*b* or the intermediate shielding tubes 3, 10*a*, 10*b*, 11*a* and 11*b*, and requires complicated heating and evacuating processes. Furthermore, since a voltage must be applied to all the intermediate shielding tubes 3, 10*a* and 10*b* or all the intermediate shielding tubes 3, 10*a*, 10*b*, 11*a* and 11*b* for conditioning, such vacuum switches requires a complicated conditioning process. Accordingly, when such a method or methods of preventing vacuum dielectric breakdown are employed, it is impossible to manufacture a vacuum switch at a reduced manufacturing cost.

Recently, electrode materials having a very high dielectric strength have been developed, which has enabled further miniaturization of the vacuum switch. Therefore, problems with conditioning the electrodes 6*a* and 6*b* have already been solved by such electrode materials and vacuum dielectric breakdown between the intermediate shielding tube 3 and the electrodes 6*a* and 6*b* has become the principal problem.

Accordingly, development of an insulating tube having a construction which will not allow the penetration breakage of the wall of the insulating tube even if vacuum dielectric breakdown occurs between the intermediate shielding tube 3 and the electrodes 6*a* and 6*b* in the conditioning process is strongly desired.

Summarizing the foregoing statement concerning the conventional vacuum switch, the ceramic insulating envelop 1 of the conventional vacuum switch, namely, a vacuum discharge device, is subject to penetration breakage in the wall thereof. In forming the conventional ceramic insulating envelop by forming alumina powder through a rubber press forming process, which is a dry forming process, a pressure is not liable to exerton the annular protrusion 2 having a large wall thickness and thereby pinholes are liable to be formed in the annular protrusion 2, because alumina powder has poor fluidity due to high friction between alumina particles. Accordingly, abnormal concentration of electric field on the pinholes occurs upon the sudden variation of the potentials of the intermediate shielding tube 3 and the holding member 4 due to vacuum dielectric breakdown during the conditioning process, and thereby penetration breakage of the insulating envelop 1 is caused.

Furthermore, since an electric field is inherently liable to be concentrated on the junctions of the sealing members 8*a* and 8*b* and the insulating envelop 1 and hence potential varies at a high potential gradient toward the outer and inner surfaces of the insulating envelop 1, the provision of the intermediate shielding tubes 3, 10*a*, 10*b*, 11*a* and 11*b* as shown in FIG. 2(*b*) is unable to mitigate satisfactorily the intensity of electric field on the outer surface of the insulating envelop 1. To obviate penetration breakage, electric field mitigating rings, not shown, must be put on the outer surfaces of the opposite ends 1*a* and 1*b* of the insulating envelop 1 in subjecting the vacuum switch to the conditioning process, which, however, requires additional work.

Still further, in the conventional vacuum switch, the sealing members 8*a* and 8*b* and the insulating envelop 1 are substantially the same in outside diameter and hence partial discharge across the sealing members 8*a* and 8*b* is liable to occur along the outer surface of the insulating envelop 1. Therefore, once a needle-shaped partial discharge occurs from either the sealing member 8*a* or the sealing member 8*b*, the sealing members 8*a* and 8*b* are short-circuited in a moment along a straight line on the outer surface of the insulating envelop resulting in external flashover.

Measures have been taken to obviate the penetration breakage of the insulating envelop in the manufacturing process and in the practical use of the vacuum switch, for example, employment of an insulating envelop having a large creeping length to increase the distance between the sealing members 8*a* and 8*b*, or the metallic layers 7*a* and 7*b*, employment of an insulating envelop having a large diameter to provide increased gaps respectively between the inner surface of the insulating envelop and the electrodes 6*a* and 6*b* and between the inner surface of the insulating envelop and the intermediate shielding tube 3, use of an insulating oil or $SF_2$ gas as an ambient medium in the conditioning process to increase the external flashover voltage, and covering the sealing members 8*a* and 8*b* respectively by electric field mitigating rings for preventing external flashover in the conditioning process.

However, it was found through the close examination of the causes of penetration breakage that the flashover voltage of the inner surface as well as the outer surface must be increased.

SUMMARY OF THE INVENTION

Accordingly, it is a first object of the present invention to provide a homogeneous insulating envelop having a large wall thickness and an intermediate shielding tube holding portion free from pinholes, and to suppress partial discharge across the sealing members in the conditioning process.

It is a second object of the present invention to intercept external flashover when partial discharge occurs from the sealing member in the conditioning process, by using a ceramic tube having a uniform wall thickness and nonlinear outer surface as an insulating envelop.

It is a third object of the present invention to provide a vacuum discharge device incorporating an insulating envelop having an inner surface having a creeping length greater than the distance between the sealing members, or the distance between the pair of metallic layers, to suppress current leakage along the outer and inner surfaces of the insulating envelop.

It is still a further object of the present invention to provide a vacuum discharge device employing an insulating envelop having a specified inside diameter, minimum size and a minimum weight for electrodes having a specified diameter, capable of withstanding heat shock, voltage and conditioning conditions in manufacture, withstanding mechanical shocks in opening and closing a circuit, stains of the material forming the electrodes on the inner surface of the insulating envelop and stains of salt on the outer surface of the insulating envelop, and capable of being manufactured at a reduced cost.

The ceramic insulating envelop of a vacuum discharge device according to the present invention is formed in a tubular shape by a slurry forming process, and has a creeping length of the ceramic insulating envelop greater than the distance between sealing member or the distance between a pair of metallic layers such as mentioned above.

Since the insulating envelop employed in the present invention is formed by a slurry forming process, the molding material, such as an alumina slurry, flows satisfactorily in forming, and the insulating envelop is homogeneous and free from defects such as pinholes.

Furthermore, since the insulating envelop employed in the present invention is formed of a ceramic material by a slurry forming process in a tubular body having a corrugated wall having a creeping length greater than the distance between sealing members or the distance between a pair of metallic layers such as mentioned above, the insulating envelop has an inner creeping length and an outer creeping length which are greater than the distance between the sealing members of the distance between the pair of metallic layers. Accordingly, partial discharge from the sealing members along the outer surface of the insulating envelop is suppressed and, even if partial discharge occurs, the discharge path is directed outward along the slope of the ridges of the corrugated wall and hence the partial discharge is unable to reach the bottom of the furrow holding an intermediate shielding tube. Consequently, the surface leakage current across the sealing members is reduced, and creeping flashover voltage for the inner and outer surfaces is increased, so that partial discharge is suppressed.

BRIEF DESCRIPTION OF THE DRAWINGS

FIGS. 8(*a*) to 8(*e*) are end views and perspective views of various insulating envelopes according to the present invention;

FIGS. 10 and 11 are modifications of the vacuum discharge device of FIG. 9;

DETAILED DESCRIPTION OF THE PREFERRED EMBODIMENTS

Figure 3:
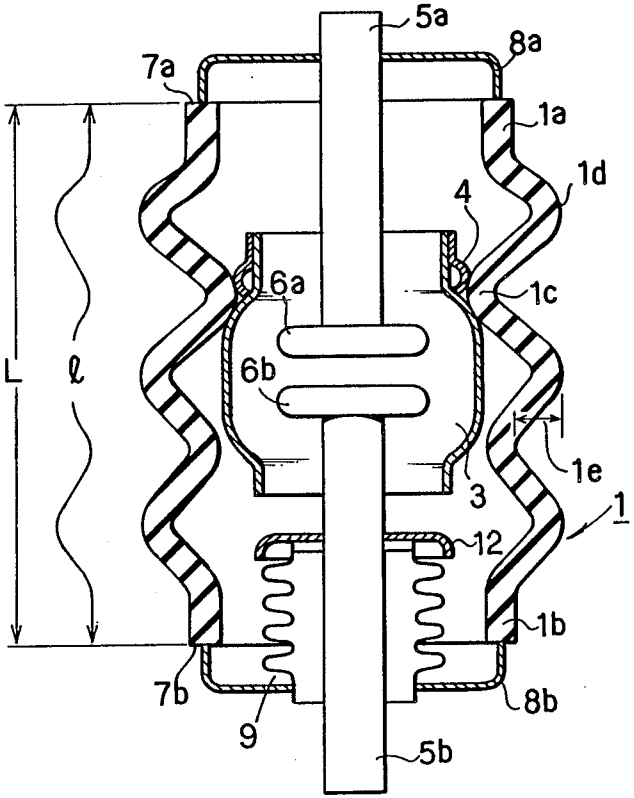
FIG. 3 is a longitudinal sectional view of a vacuum discharge device in a first embodiment according to the present invention.

Referring to FIG. 3 showing a vacuum discharge device in a first embodiment according to the present invention, indicated at 1 is an alumina ceramic insulating envelop having a corrugated shape formed by sintering in air at about 1650° C. a dried alumina molding formed by a slurry forming process. The insulating envelop 1 is substantially uniform in wall thickness. The inside diameter of an inner ridge 1*c* holding an intermediate shielding tube 3 of the insulating envelop 1 is the same as or smaller than that of the inside diameter of the opposite ends 1*a* and 1*b* of the insulating envelop 1, and hence the intermediate shielding tube 3 can be inserted in the insulating envelop 1 through either the end 1*a* or the end 1*b*. The respective inside diameters of other inner ridges of the insulating envelop 1 are the same as that of the opposite ends 1*a* and 1*b*. The outside diameter of outer ridges 1*d* is greater than those of the opposite ends 1*a* and 1*b*. Metallized layers 7*a* and 7*b* are formed respectively over the end surfaces of the opposite ends 1*a* and 1*b* by a Mo-Mn metallizing process. Metallic sealing members 8*a* and 8*b* are attached respectively to the opposite ends 1*a* and 1*b* of the insulating envelop 1. The intermediate shielding tube 3 is held mechanically in place on the inner ridge 1*c* with a holding member 4. A fixed electrode 6*a* and a movable electrode 6*b* are disposed opposite to each other in a space confined by the intermediate shielding tube 3.

Figure 4:
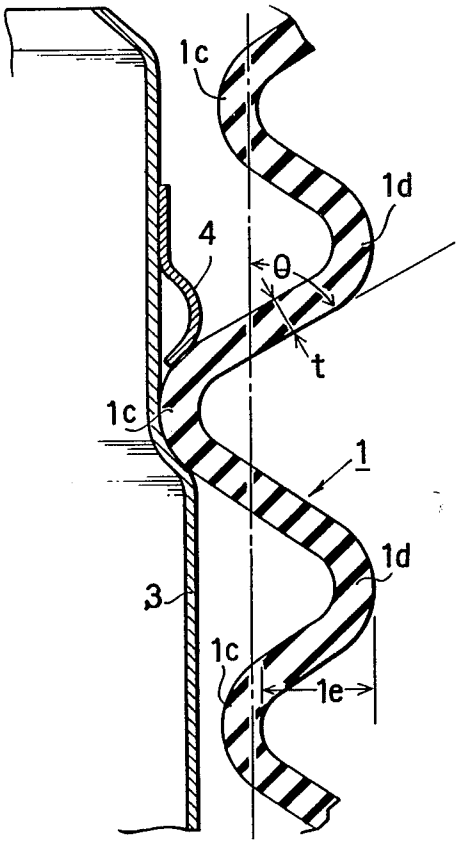
FIG. 4 is an enlarged fragmentary longitudinal sectional view showing the ridges and furrows of the insulating envelop of the vacuum discharge device of FIG. 3.

In FIGS. 3 and 4, indicated at 1*e* is the depth of furrows in the outer surface of the insulating envelop 1, at L is the distance between the sealing members 8*a* and 8*b*, namely, the distance between the metallic layers 7*a* and 7*b*, at l is the outer or inner creeping length of the insulating envelop 1, and at t is the wall thickness of the insulating envelop 1. In this embodiment, the average wall thickness is 4.5 mm, the depth 1*e* is in the range of 11 to 18 mm, and the creeping length ratio $\alpha$, namely, the ratio of the creeping length l to the distance L, is 1.3.

The sealing members 8*a* and 8*b* are in sealing contact respectively with the metallic layers 7*a* and 7*b*. The respective potentials of the sealing members 8*a* and 8*b* are the same as those of the electrodes 6a and 6b, respectively. A protective cover 12 is attached to the upper end of the bellows 9.

As shown in FIG. 4, the slopes of the outer ridges 1d of the insulating envelop 1 are inclined at an inclination $\theta$ (in this embodiment, 60°) to the axis of the insulating envelop.

Twenty vacuum switches of rated voltage of 7.2 kV each incorporating the insulating envelop 1 were fabricated, and then the vacuum switches were subjected to a conditioning process, in which a voltage of 50 kV ac was applied to the vacuum switches after evacuation for conditioning. During the conditioning process, vacuum dielectric breakdown occurred between the intermediate shielding tube 3 and the electrodes 6a and 6b, whereas no penetration breakage occurred in the insulating envelops 1. It was found through tests that surface leakage current on the surface of the insulating envelops 1 was very small as compared with that on the surface of the conventional insulating envelop. It was also found that the external flashover voltage across the sealing members 8a and 8b of the insulating envelop 1 of this embodiment was 1.18 to 1.2 times that of the conventional insulating envelop.

Insulating envelops formed by a slurry forming process by using molding materials containing materials other than alumina ($Al_2O_3$, such as MgO, MnO, $TiO_2$ and $ZrO_2$, as principal components were tested. In those test insulating envelopes, the adhesion of the metallic layers formed by a Mo-Mn metallizing process was unstable and the test insulating envelops were found to be unapplicable to the vacuum discharge device.

In the vacuum discharge device according to the present invention, penetration breakage occurs hardly in the vicinity of the holding part of the intermediate shielding tube 3 or in the vicinity of the sealing members 8a and 8b in the insulating envelop 1 when vacuum dielectric breakdown occurs between the intermediate shielding tube 3 and the electrodes 6a and 6b, and the external flashover voltage across the sealing members 8a and 8b is comparatively high. Such advantageous characters of the vacuum discharge device of the present invention are considered to be attributable to the following reasons.

First, the insulating envelop 1 is formed by an alumina slurry forming process instead of the rubber press forming process, which is a dry forming process, alumina particles are able to move freely relative to each other during the forming process, and hence the corrugated insulating envelop 1 can easily be formed in a homogeneous construction and in a uniform wall thickness. It was found through the comparative examination of the portions 1a, 1b, 1c and 1d of the insulating envelop 1 in terms of properties of the material, such as density, transverse rupture strength, and the density of pinholes, that the insulating envelop 1 formed by the slurry forming process and the high-temperature sintering process has excellent uniformity in quality.

The insulating envelop 1 of the vacuum discharge device of FIG. 3 has an external flashover voltage 1.18 to 1.2 times that of the conventional insulating envelop, and the creeping length l thereof is 1.3 times that of the conventional insulating envelop. Accordingly, the relation between the external flashover voltage V and the creeping length l is expressed by $V \propto l^{2/3}$. This relation is similar to a relation for the insulator and the back electrode effect can be neglected. Since the external flashover voltage of the insulating envelop 1 of the present invention is higher than that of the conventional insulating envelop, it is inferred that no external partial discharge occurred in the vacuum discharge device of the present invention during the conditioning process, and thereby surface leakage current in the sealed opposite ends 1a and 1b of the insulating envelop 1 is suppressed and potential distribution on the insulating envelop 1 is uniform. Since the outside diameter of the outer ridges 1d is greater than those of the opposite ends 1a and 1b, the shielding effect of the outer ridges 1d prevents partial discharge across the sealed opposite ends 1a and 1b along the outer surface of the insulating envelop 1.

Even if partial discharge occurs across the sealing members 8a and 8b, penetration breakage will hardly occur in the insulating envelop 1 of FIG. 3, because partial discharge occurs along a straight path from one of the sealing members 8a and 8b to the other, and the spark discharge never travels from the ridge 1d toward the bottom of the furrow. Accordingly, the spark discharge will not reach the inner ridge 1c supporting the intermediate shielding tube 3. Thus, penetration breakage in the vicinity of the portion supporting the intermediate shielding tube 3 of the insulating envelop 1 is prevented.

It was found through the experimental use of the vacuum switch in the first embodiment according to the present invention, that the inner creeping length of the insulating envelope 1.3 times that of the insulating envelop of the conventional vacuum switch increases the electrical life of the vacuum switch remarkably. The number of opening and closing operation of the vacuum switch of the present invention repeated before the occurrence of internal creeping discharge due to the deposition of the material of the electrodes on the inner surface of the insulating envelop is three times that of the conventional vacuum switch.

The respective inside diameters of all the inner edges of the insulating envelop 1 may be smaller than the inside diameters of the opposite ends 1a and 1b of the insulating envelop 1.

Although the insulating envelop 1 of the vacuum switch in the first embodiment has the plurality of ridges and furrows and the inner ridge 1c holding the intermediate shielding tube 3, an insulating envelop having only one ridge may be employed in a vacuum discharge device of the present invention.

Figure 5:
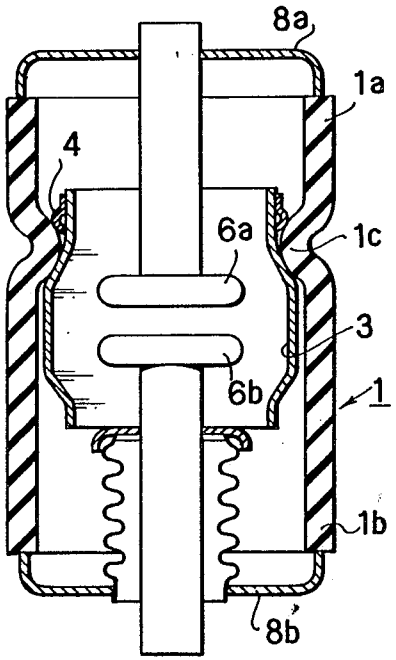
FIGS. 5 to 7 are longitudinal sectional views of modifications of the vacuum discharge device of FIG. 3.
Figure 6:
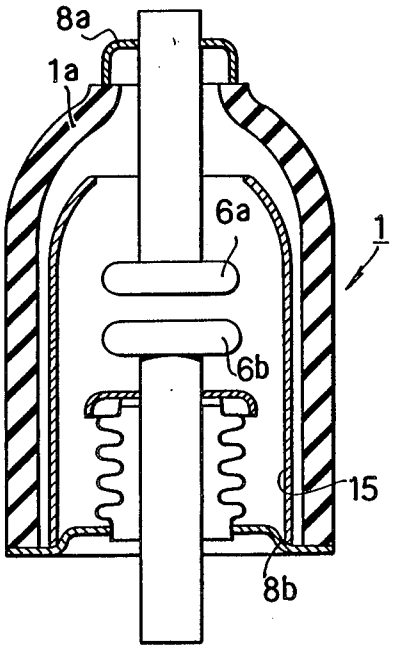
Figure 7:
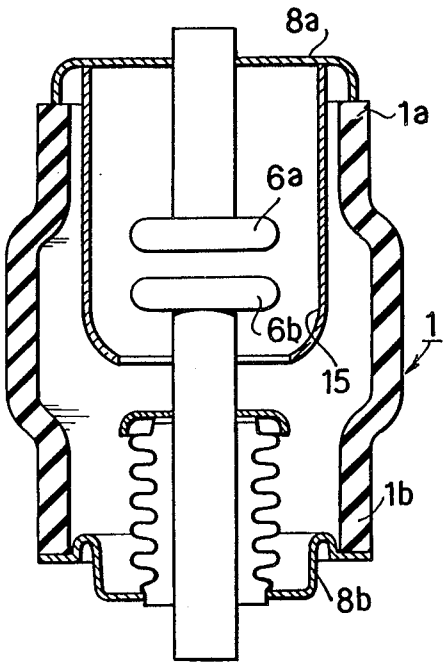

Modifications of the vacuum discharge device shown in FIG. 3 are shown in FIGS. 5 to 7.

Figure 1:
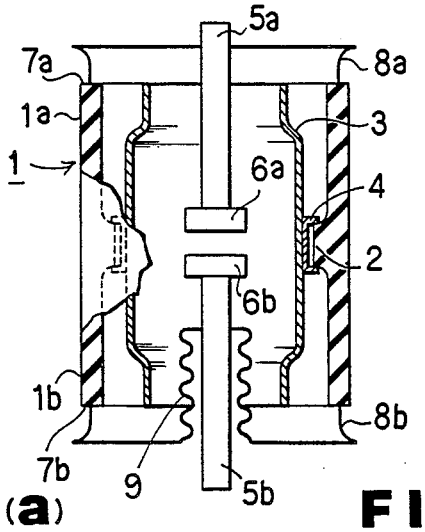
FIG. 1 (PRIOR ART)
FIG. 1 is a longitudinal sectional view of a conventional vacuum discharge device.
Figure 2A:
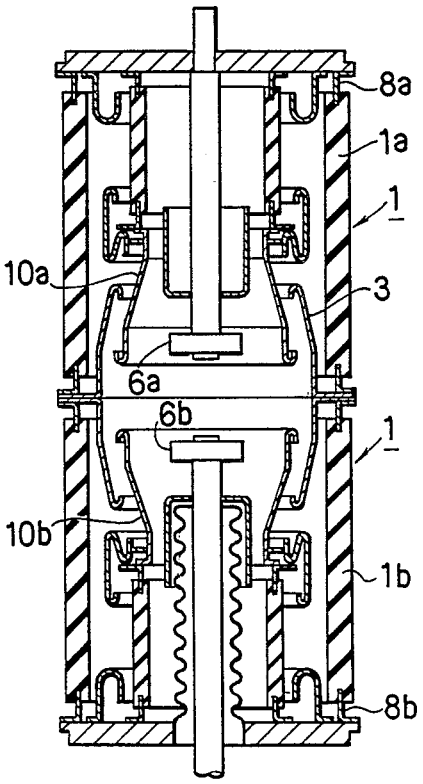
FIG. 2(a) (PRIOR ART)
FIGS. 2(*a*) and 2(*b*) are longitudinal sectional views of further conventional vacuum discharge devices.
Figure 2B:
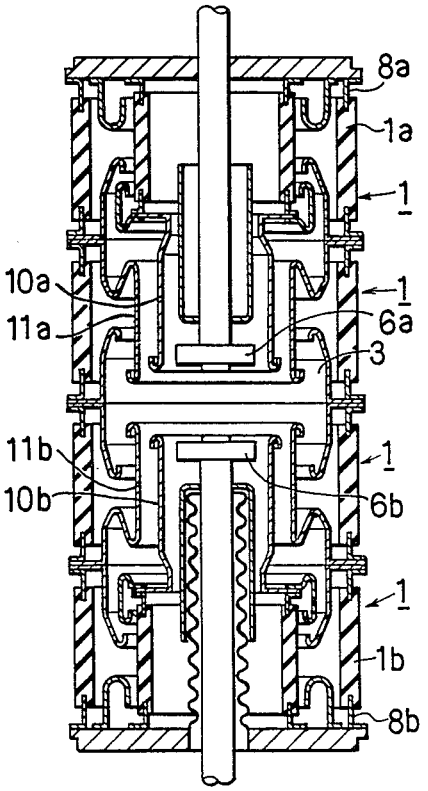
FIG. 2(b) (PRIOR ART)

In a first modification shown in FIG. 5, an insulating envelop 1 is provided with only one inner ridge 1c for holding an intermediate shielding tube 3, which is similar to the conventional insulating envelop shown in FIG. 1. However, formed by a ceramic slurry forming process the insulating envelop 1 of the present invention is homogeneous in construction and is uniform in wall thickness. Although the creeping length and the external flashover voltage is substantially the same as those of the conventional insulating envelop, the insulating envelop in the first modification is obviously better than the conventional insulating envelop in respect of penetration breakage.

A vacuum switch in a second modification shown in FIG. 6 has a shielding tube 15 supported at one end thereof, an insulating envelop 1 having a creeping length 1.1 times that of the conventional insulating envelop, and a sealing member 8a having an outside diameter less than half that of the conventional sealing member. The external flashover voltage of this vacuum switch is higher than that of the conventional vacuum switch.

A vacuum switch in a third modification shown in FIG. 7 has a shielding tube 15 supported at one end thereof, and an insulating envelop 1 having a middle portion having an outside diameter greater than those of the opposite ends 1*a* and 1*b* thereof. The creeping length of the insulating envelop 1 is 1.1 times that of the conventional insulating envelop. This vacuum switch has an improved external flashover voltage and an extended electrical life.

Although the insulating envelops 1 employed in the first embodiment and the foregoing modifications each have a circular cross section, the insulating envelop need not necessarily be limited thereto, but may be such as having an optional cross section, for example, an elliptic, octagonal, hexagonal or rectangular cross section. Insulating envelops having an elliptic or rectangular cross section are particularly preferable for use in a vacuum switch for a three-phase vacuum breaker, because such insulating envelops enables effective use of space.

Although the present invention has been described as applied to a vacuum switch, the present invention is effectively applicable also to vacuum discharge devices each having a metallic shielding tube supported at the middle portion or at one end thereof, such as vacuum lightning arresters, vacuum triggertrons and vacuum fuses.

As is apparent from the foregoing description, in a first aspect of the present invention, the ceramic insulating envelop for a vacuum discharge device is formed by a slurry forming process, has a creeping length greater than the distance between the sealing members attached respectively to the opposite ends thereof, which improves the yield of the process for conditioning vacuum discharge devices and enables vacuum discharge devices to be formed in a compact construction and to be manufactured at a reduced manufacturing cost.

Figure 9:
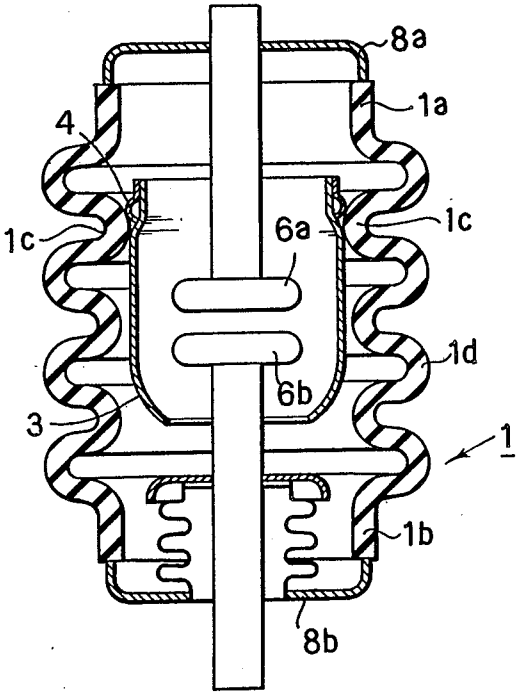
FIG. 9 is a longitudinal sectional view of a vacuum discharge device in a second embodiment according to the present invention.

A vacuum discharge device in a second embodiment according to the present invention will be described hereinafter with reference to FIG. 9. This vacuum discharge device employs a corrugated insulating envelop 1 having ridges each having slopes inclined at an inclination $\theta$ of 90° to the axis of the insulating envelop 1. Sealing members 8*a* and 8*b* are attached respectively to the opposite ends of the insulating envelop 1. The creeping length ratio $\alpha$, namely, the ratio of the creeping length l to the distance L between the sealing members 8*a* and 8*b*, of the insulating envelop 1 is 1.4. This insulating envelop 1 has increased effects of suppressing surface leakage current, suppressing partial discharge from the sealing members 8*a* and 8*b* along the outer surface of the insulating envelop 1 and preventing penetration breakage in the insulating envelop 1.

Figure 10:
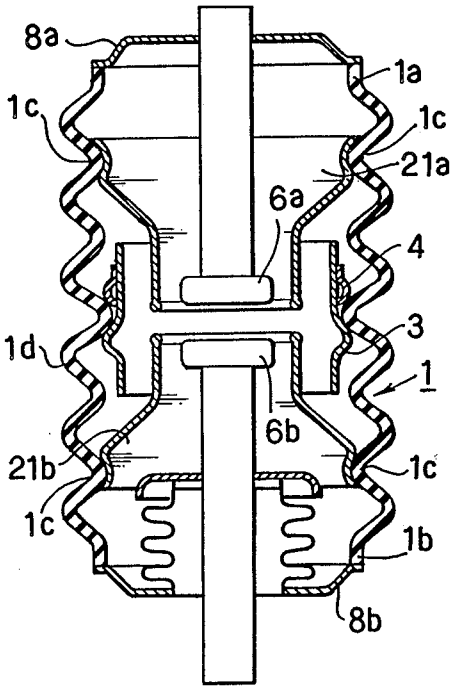

FIG. 10 shows a modification of the vacuum discharge device in the second embodiment according to the present invention. This modification is a vacuum switch of rated voltage of 84 kV, having a plurality of intermediate shielding tubes, namely, a first intermediate shielding tube 3 and a pair of metallic second intermediate shielding tubes 21*a* and 21*b*. Referring to FIG. 10, the pair of second intermediate shielding tubes 21*a* and 21*b* are disposed coaxially so as to surround electrodes 6*a* and 6*b*, respectively. The distance between the opposite ends of the second intermediate shielding tubes 21*a* and 21*b* is smaller than the gap between the electrodes 6*a* and 6*b*. The second intermediate shielding tubes 21*a* and 21*b* are held respectively by the inner ridges 1*c* of a corrugated insulating envelop 1. The second intermediate shielding tubes 21*a* and 21*b*, for example, are formed of a shape memory alloy and are heated to fasten the same in place as shown in FIG. 10 after inserting the same in the insulating envelop 1.

FIG. 11 shows a further modification of the vacuum discharge device in the second embodiment according to the present invention. This modification is a vacuum switch of rated voltage of 120 kV, having a plurality of intermediate shielding tubes, namely, a first intermediate shielding tube 3, a pair of second intermediate shielding tubes 21*a* and 21*b*, and a pair of intermediate shielding tubes 22*a* and 22*b*. The second intermediate shielding tubes 21*a* and 21*b* are disposed coaxially so that the respective free ends thereof are positioned inside the first intermediate shielding tube 3, and the third intermediate shielding tubes 22*a* and 22*b* are disposed coaxially so that the free ends thereof surround the corresponding second intermediate shielding tubes 21*a* and 21*b*. The distance between the opposed ends of the third intermediate shielding tubes 22*a* and 22*b* is smaller than that between the opposed ends of the second intermediate shielding tubes 21*a* and 21*b*. The first intermediate shielding tube 3, the second intermediate shielding tubes 21*a* and 21*b*, and the third intermediate shielding tubes 22*a* and 22*b* are held in place respectively in furrows between the adjacent inner ridges 1*c* of the insulating envelop 1.

In conditioning the vacuum discharge device of FIG. 11, a conditioning voltage of 350 kV or above is applied across the electrodes 6*a* and 6*b*. As the conditioning process progresses, vacuum dielectric breakdown occurs sequentially between the second intermediate shielding tubes 21*a* and 21*b* and the third intermediate shielding tubes 22*a* and 22*b*. The final dielectric strength of the vacuum discharge device was 350 kV or above, and no penetration breakage occurred in the insulating envelop 1 having a substantially uniform wall thickness.

In the vacuum discharge devices shown in FIGS. 3, 4, 9, 10 and 11, the intermediate shielding tubes 3, 21*a*, 21*b*, 22*a* and 22*b* are held by the inner ridges 1*c* or in furrows between the adjacent inner ridges 1*c*. Therefore, the insulating envelops 1 do not need any additional surface area for holding the intermediate shielding tubes, and hence the evacuating process is simplified.

Since the electrodes 6*a* and 6*b* and the intermediate shielding tubes 21*a*, 21*b*, 22*a* and 22*b* are conditioned simultaneously by applying a voltage across the electrodes 6*a* and 6*b*, the conditioning process is simplified.

Although the second embodiment of the present invention has been described as embodied in a vacuum switch, the second embodiment can be embodied in a high-voltage vacuum discharge device, such as a vacuum fuse, a vacuum lightning arrester or a vacuum triggertron, for the same effects.

Although the ceramic insulating envelops of the foregoing embodiments and modifications are formed of an alumina ceramic material, the ceramic insulating envelops may be formed of any suitable ceramic material provided that the ceramic insulating envelops can be sealed by the sealing members 8*a* and 8*b*. Furthermore, the present invention is applicable also to vacuum discharge devices having two fixed electrodes instead of the fixed electrode 6*a* and the movable electrode 6*b*.

Thus, the vacuum discharge device in the second embodiment according to the present invention employs a corrugated insulating envelop formed of a ceramic material and having a uniform wall thickness and a creeping length greater than the distance between the sealing members, and is provided with a plurality of intermediate shielding tubes held by the inner ridges or in furrows between the adjacent inner ridges of the insulating envelop. Such a configuration of the vacuum discharge device improves the yield of the conditioning process and enables the vacuum discharge device to be manufactured at a reduced manufacturing cost.

Incidentally, in the first embodiment, the wall thickness t (FIG. 4) and the radius r of curvature of the bottom of a furrow between the adjacent ridges of the insulating envelop is substantially the same. When $t>r$, the insulating envelop is unable to meet the foregoing requisite conditions of performance, namely, endurance to heat shocks and endurance to mechanical shocks and vibrations caused by the opening and closing operation of the electrodes, and is liable to be fissured by heat shocks or mechanical shocks or vibrations. Therefore, the insulating envelop must meet a relation: $t \leqq r$.

Desirably, the inclination $\theta$ of the slope of the ridge of the insulating envelop to the axis of the latter is in a range defined by $45° \leqq \theta \leqq 90°$. When the inclination $\theta<45°$, it is impossible to form an insulating envelop having a sufficiently large creeping length ratio $\alpha(\alpha=l_1/L$ or $l_2/L$, where $l_1$ is creeping length of the insulating envelop, $l_2$ is the inner creeping length of the insulating envelop, and L is the distance between the metallic layers *7a* and *7b*) and, in such an insulating envelop, the back electrode effect is not negligible. When $\theta>90°$, it is difficult to form the insulating envelop by a slurry forming process.

Desirably, the depth e of the furrows of the corrugated insulating envelop is 1.5 times the radius r of curvature of the bottom of each furrow or greater. When $e<1.5r$, the back electrode effect is not negligible regardless of the inclination $\theta$.

To form the insulating envelop in a substantially uniform wall thickness, the outer creeping length $l_1$ and the inner creeping length $l_2$ must approximately be the same. When it is desired to increase the external creeping flashover voltage at least by 10%, the insulating envelop must meet a condition: $l_1 \approx l_2 \geqq 1.2L$.

Figure 12:
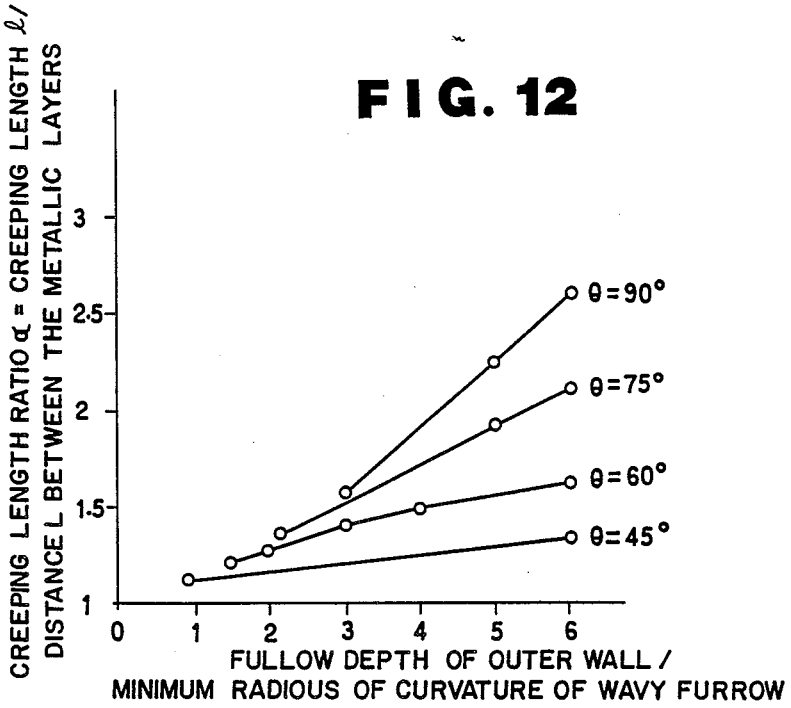
FIG. 12 is a graph showing the relation between the creeping length ratio and constants defining the corrugated shape of the insulating envelop.

FIG. 12 is a graph showing the variation of the creeping length ratio $\alpha$ with the ratio e/r for the inclination $\theta$, in which the depth e is supposed to be constant for all the outer furrows of the insulating envelop. It is desirable that e/r is 1.5 or greater and $\alpha$ is 1.2 or greater.

Figure 13:
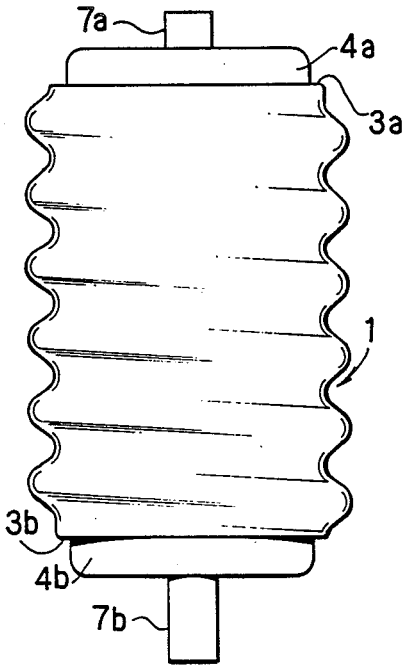
FIG. 13 is an elevation of a vacuum discharge device in a third embodiment according to the present invention.

The wall of the corrugated insulating envelop according to the present invention need not necessarily have individual parallel ridges and furrows extending in parallel to the metallic layers *7a* and *7b*, but may have a single spiral ridge and a single spiral furrow as shown in FIG. 13.

Figure 15:
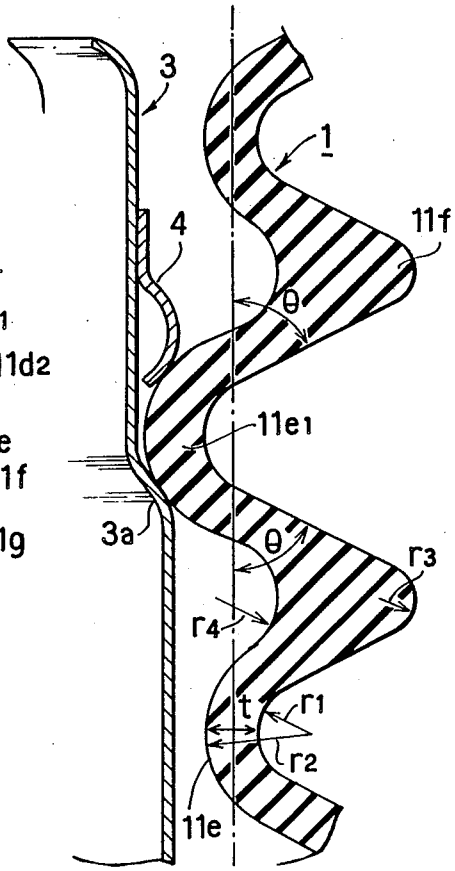
FIG. 15 is an enlarged fragmentary longitudinal sectional view of the vacuum discharge device of FIG. 14, showing an essential portion of the vacuum discharge device.
Figure 14:
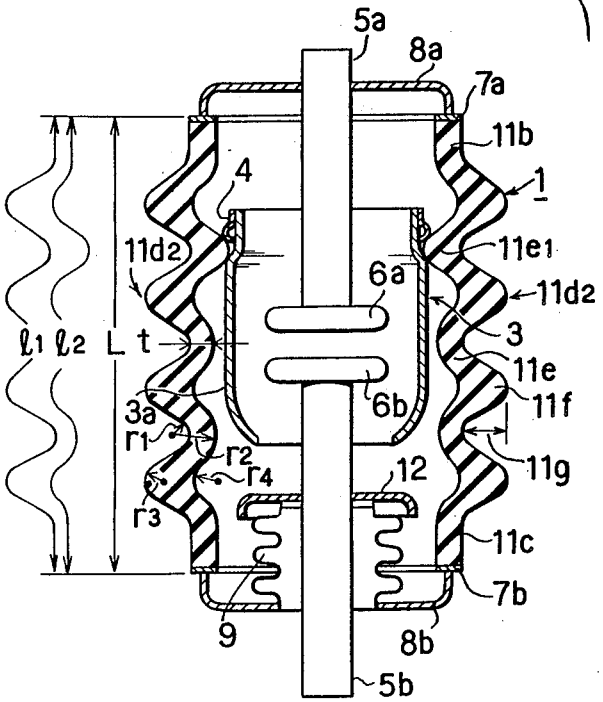
FIG. 14 is a longitudinal sectional view of a vacuum discharge device in a third embodiment according to the present invention.

A vacuum discharge device in a third embodiment according to the present invention will be described hereinafter with reference to the accompanying drawings. FIG. 14 is a longitudinal sectional view of the vacuum discharge device embodying the present invention, and FIG. 15 is an enlarged fragmentary longitudinal sectional view showing an essential portion of the vacuum discharge device of FIG. 14. Referring to FIGS. 14 and 15, a corrugated alumina ceramic insulating envelop 1 has an upper annular portion 11*b*, a lower annular portion 11*c*, wavy outer ridges 11*d*2 formed in the outer surface of the wall of the insulating envelop 1 between the upper annular portion 11*b* and the lower annular portion 11*c*, wavy inner ridges 11*e* formed between the adjacent outer ridges 11*d*2 in a uniform wall thickness. The wall thickness of the inner ridges 11*e* need not be the same as that of the outer ridges 11*d*2. Indicated at 11*e*1 is one of the inner ridges 11*e*, namely, a shielding tube holding ridge, for holding an intermediate shielding tube 3. The height of the shield holing ridge 11*e*1 is greater than that of the rest of the inner ridges 11*e*. Indicated at 11*f* is the crest of each outer ridge 11*d*2, and at 11*g* is the depth of outer furrows between the adjacent outer ridges 11*d*2. Indicated at r1 is the radius of curvature of the bottom of the outer furrow, at r2 is the radius of curvature of the crest of the inner ridge 11*e*, r3 is the radius of curvature of the crest 11*f* of the outer ridge 11*d*2, at r4 is the radius of curvature of the bottom of the inner furrow, at t is the wall thickness of the wavy inner ridges 11*e*, which is substantially equal to the radius of curvature r1 of the bottom of the outer furrow. Indicated at $\theta$ is the inclination of the flat slop of each outer ridge 11*d*2 to an axis parallel to the axis of the insulating envelop 1. The intermediate shielding tube 3 has an outer bulged portion 3*a*, and an attachment 4 attached to the outer circumference of the upper reduced tubular portion of the intermediate shielding tube 3. The attachment 4 is a metallic member having an externally curved portion. The shielding tube holding ridge 11*e*1 is received between the shoulder of the outer bulged portion 3*a* and the attachment 4 to support the intermediate shielding tube 3 on the insulating envelop 1.

A process of manufacturing the insulating envelop 1 will be described hereinafter.

A molding is formed by molding alumina slurry by a slurry forming process, and then the molding is burnt in air at about 1650° C. to make the insulating envelop 1. The insulating envelop 1 is, for example, 4.7 mm in the wall thickness of the upper annular portion 11*b* and the lower annular portion 11*c*, about 8 mm in the radius of curvature r1 of the bottom of the furrow between the adjacent outer ridges 11*d*2, about 3 mm in the radius of curvature r3 of the crest 11*f* of the outer ridge 11*d*2, a value in the range of 12 to 18 mm in the depth 11*g* of the outer furrow, a value in the range of 3 to 5 mm in the depth of the inner furrow, and an angle of 60° in the inclination $\theta$.

The distance L between a pair of metallic layers *7a* and *7b* formed respectively at the opposite ends of the insulating envelop 1 is 96 mm, the outer creeping length $l_1$ of the insulating envelop 1 is 150 mm, and the inner creeping length $l_2$ of the insulating envelop 1 is 105 mm. Thus, the creeping length ratio $\alpha_1=l_1/L=1.56$ and $l_2/L \approx 1.105$.

Twenty vacuum switch tubes of 12 kV rated voltage each incorporating the insulating envelop 1 formed through the foregoing processes were fabricated, the vacuum switch tubes were evacuated, and then a voltage of 60 kV ac was applied to the vacuum switch tubes for conditioning. No penetration breakage occurred in the insulating envelops 1. The external flashover voltage across the metallic layers *7a* and *7b* of the insulating envelopes 1 was 1.35 times that of the conventional insulating envelop or higher. The external flashover voltage when the insulating envelop 1 was stained by salt by an equivalent saline fog test was 1.4 times that of the conventional insulating envelop having the length L of 95 mm.

Deposition of the material forming the electrodes 6a and 6b of the vacuum switch tube over the inner surface of the insulating envelop 1 increases gradually with the repetition of cutting off the current between the electrodes 6a and 6b. However, it was found that the impulsive withstand voltage characteristics of the vacuum switch tubes was deteriorated scarcely and the current cut-off life of the vacuum switch tubes before the first internal creeping flashover was twice that of the conventional vacuum switch tube.

Furthermore, the thickness t of the inner ridges 11e and 11e of the corrugated wall of the insulating 11e and 11e1 of the corrugated envelop is uniform, the depth 11g of the outer furrows is large, the quality of the material forming the upper annular portion 11b, the lower annular portion 11c, the inner edges 11e, the crest 11f and the flat portions of the outer ridges 11d2 is homogeneous, the insulating envelop 1 is uniform in density and transverse rupture strength, has a very small number of pinholes as compared with the ceramic envelop formed by the conventional rubber press process, is uniform in quality and has a high external flashover voltage.

The insulating envelop 1 of the present invention has the foregoing characteristics. In the conventional insulating envelop 1, the drop of the external creeping flashover voltage, namely, back electrode effect, occurs when the intermediate shielding tube 3 is provided within the evacuated insulating envelop 1.

However, in this embodiment of the present invention, the relation between the external flashover voltage V and the outer creeping length $l_1$ is expressed by $V \propto l_1^{\frac{2}{3}}$, and this relation is similar to a relation for the insulator, and hence back electrode effect is negligible. Accordingly, even if external flashover occurs across the metallic layers 7a and 7b, the discharging path of the external flashover extends from the upper metallic layer 7a through the outer crests 11f to the lower metallic layer 7b (FIG. 14), and does not extend through the bottom of the outer furrow corresponding to the inner ridge 11e1 supporting the intermediate shielding tube 3. Therefore, penetration breakage occurs hardly in the insulating envelop 1 in the vicinity of the inner ridge 11e1 supporting the intermediate shielding tube 3.

Furthermore, in the vacuum switch tube incorporating the conventional insulating envelop 1 having no corrugations in the outer and inner surface thereof, the drop of the impulsive withstand voltage was greater than that of the AC withstand voltage when the material forming the electrodes deposited over the inner surface of the insulating envelop 1.

Although the deposition of the material forming the electrodes over the inner surface of the insulating envelop 1 of the present invention is unavoidable as current cut-off operation is repeated, the impulsive withstand voltage of the insulating envelop 1 of the present invention decreases scarcely.

Although the insulating envelop 1 in this embodiment is about *3* mm in the radius of curvature r3 of the crest 11f of the outer ridge 11d2, a value in the range of 12 to 18 mm in the depth 11g of the furrow between the outer ridges 11d2 and an angle of 60° in the inclination $\theta$, the shape of the outer ridges 11d2 need not be limited to that of the insulating envelop 1 described hereinbefore, but may be any shape suitable for forming a compact, lightweight vacuum discharge device and meeting the requisite conditions of performance of the insulating envelop such as stated in the conditions (a) to (e) with reference to related art.

Although, in this embodiment, the wall thickness t of the inner ridge 11e is approximately equal to the radius of curvature r1 of the outer furrow between the adjacent outer ridges 11d2, the insulating envelop is unable to satisfy the requisite conditions of performance (a), (e) and is liable to be fissured by heat shocks or mechanical shocks, when $t > r1$. Therefore, the insulating envelop must meet an inequality: $t \leqq r1$.

Furthermore, desirably, $45 \leqq \theta \leqq 90°$ (FIG. 15). When $\theta < 45°$, the creeping length ratio $\alpha (= l_1/L$ *or* $l_2/L$, $l_1$ is the outer creeping length, $l_2$ is the inner creeping length, and L is the distance between the upper metallic layer 7a and the lower metallic layer 7b) is not sufficiently large, and hence the back electrode effect is not negligible. When $\theta > 90°$, it is difficult to form the insulating envelop by a slurry forming process and the insulating envelop is unable to meet the requisite conditions (a) and (e).

Desirably, the depth 11g of the outer furrow between the adjacent outer ridges 11d2 is 1.5 times the radius of curvature r1 of the same furrow or greater. When $11g < 1.5 \times r1$, the back electrode effect is not negligible even if the inclination $\theta$ is appropriate.

The wall thickness t of the inner ridges 11e must be substantially uniform over the entire length, the inner creeping length $l_2$ must be 1.2 times the distance L between the metallic layers 7a and 7b to secure a satisfactory strength against mechanical shocks, and the outer creeping length $l_1$ must meet an inequality: $l_1 \geqq 1.2L$ to improve the external creeping flashover voltage at least by 10%.

Figure 16:
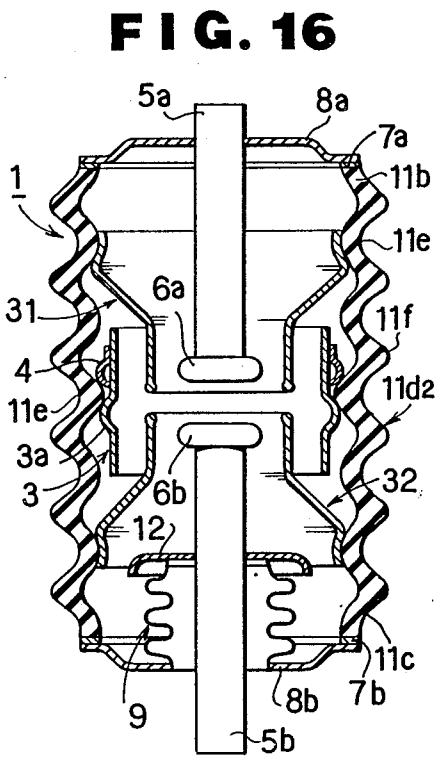
FIG. 16 is a longitudinal sectional view of modification of the vacuum discharge device of FIG. 14.

FIG. 16 is a longitudinal sectional view of a vacuum switch tube in a second embodiment according to the present invention. In this embodiment, the axial length of an intermediate shielding tube 3 is smaller than that of the intermediate shielding tube 3 shown in FIG. 14. An inner ridge 11e is received between an external rib 3a formed in the axially middle portion of the intermediate shielding tube 3 and an attachment 4 attached to the intermediate shielding tube 3 to support the intermediate shielding tube 3 on an insulating envelop 1. A pair of funnel-shaped metallic intermediate shielding tubes 31 and 32 are disposed with the respective narrow portions received in the intermediate shielding tube 3. The inner ridges 11e engages the respective large portions of the intermediate shielding tubes 31 and 32 to support the intermediate shielding tubes 31 and 32 within the insulating envelop 1. Thus, the vacuum switch tube in the second embodiment is provided with the three intermediate shielding tubes 3, 31 and 32.

What is claimed is:

1. A vacuum discharge device comprising:

an insulating envelop provided with metallic layers respectively at the opposite ends thereof;

a pair of electrodes disposed opposite to each other within the insulating envelop; and sealing members brazed respectively to the metallic layers formed in the opposite ends of the insulating envelop and maintained at the same potential as that of the electrodes;

characterized in that the insulating envelop is a hollow, generally cylindrical ceramic member having an internally and externally corrugated wall, and the outer creeping length and inner creeping length of the insulating envelop are greater than the distance between the sealing members or between the metallic layers.

2. A vacuum discharge device according to claim 1, wherein the wall thickness of said insulating envelop is substantially uniform.

3. A vacuum discharge device according to claim 1, wherein said insulating envelop is formed of a material containing alumina as a principal component by a slurry forming process.

4. A vacuum discharge device according to claim 1, wherein said insulating envelop has a circular, elliptic, polygonal, square or rectangular cross section.

5. A vacuum discharge device according to claim 1, wherein the outside diameter of the insulating envelop is greater than that of the sealing members.

6. A vacuum discharge device according to claim 1, wherein a metallic intermediate shielding tube is held within the insulating envelop by an inner ridge of the corrugated wall of said insulating envelop.

7. A vacuum discharge device according to claim 1, wherein the inside diameter of the inner ridge holding said intermediate shielding tube is smaller than the inside diameter of the opposite ends of the insulating envelop.

8. A vacuum discharge device according to claim 1, wherein the outside diameter of the outer ridges of the corrugated wall of said insulating envelop is greater than the outside diameter of the opposite ends of said insulating envelop.

9. A vacuum discharge device according to claim 6, further comprising a plurality of intermediate shielding tubes.

10. A vacuum discharge device according to claim 1, wherein the radius (r) of the bottom of each furrow in the corrugated wall of said insulating envelop is greater than a maximum wall thickness (t) of the corrugated wall.

11. A vacuum discharge device according to claim 1, wherein the inclination ($\theta$) of the slope of each ridge in the corrugated wall of said insulating envelop to the axis of said insulating envelop is in the range of 45° to 90°.

12. A vacuum discharge device according to claim 1, wherein the depth (e) of each furrow in the corrugated wall of said insulating envelop is 1.5 times that of the radius (r) of curvature of the bottom of the furrow or greater.

13. A vacuum discharge device according to claim 1, wherein the outer creeping length ($l_1$) is approximately equal to the inner creeping length ($l_2$), and the outer creeping length ($l_1$) and the inner creeping length ($l_2$) are 1.2 times the distance (L) between the metallic layers or greater.

14. A vacuum discharge device according to claim 1, wherein the outer and inner ridges of the corrugated wall of said insulating envelop are formed in a spiral form.

15. A vacuum discharge device according to claim 1, wherein the radius of curvature of the wavy ridge of the inner ridge is greater than that of the crest of wavy ridge at the outer of said insulating envelop.

16. A vacuum discharge device according to claim 1, wherein the thickness of the crest of wavy ridge is greater than that of the inner ridge.

17. A vacuum discharge device according to claim 1, wherein the minimum outer diameter of radius of curvature of the wavy inner ridge is greater than the maximum thickness of said wavy inner ridge.

18. A vacuum discharge device according to claim 1, the minimum outer diameter of radius of curvature of the crest of said wavy ridge is smaller than the maximum thickness of said crest of said wavy ridge.

19. A vacuum discharge device according to claim 1, wherein the respective relations among the inner creeping length ($l_1$), outer creeping length ($l_2$) and the distance (L) between the metallic layers, is $l_2 \leqq 1.2L$, $l_1 \geqq 1.2L$ respectively.

* * * * *